US011191297B2

(12) United States Patent
Phillips et al.

(10) Patent No.: US 11,191,297 B2
(45) Date of Patent: Dec. 7, 2021

(54) SMOKELESS PRODUCTS CONTAINING NON-TOBACCO PLANT MATERIALS

(71) Applicant: Altria Client Services LLC, Richmond, VA (US)

(72) Inventors: David Phillips, Richmond, VA (US); Daniel Katillus, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 414 days.

(21) Appl. No.: 15/860,223

(22) Filed: Jan. 2, 2018

(65) Prior Publication Data

US 2019/0200667 A1 Jul. 4, 2019

(51) Int. Cl.

| | |
|---|---|
| ***A24B 15/16*** | (2020.01) |
| ***A24B 15/24*** | (2006.01) |
| ***A24B 15/38*** | (2006.01) |
| ***A24B 3/12*** | (2006.01) |
| ***A24B 13/00*** | (2006.01) |
| ***A24B 15/30*** | (2006.01) |

(52) U.S. Cl.

CPC ..... *A24B 15/16* (2013.01); *A24B 3/12* (2013.01); *A24B 13/00* (2013.01); *A24B 15/24* (2013.01); *A24B 15/303* (2013.01); *A24B 15/385* (2013.01)

(58) Field of Classification Search

CPC ..... A24B 15/00

See application file for complete search history.

(56) References Cited

U.S. PATENT DOCUMENTS

| | | | | |
|---|---|---|---|---|
| 6,619,293 | B1 * | 9/2003 | Siadto | A24B 15/16 131/359 |
| 8,999,405 | B1 | 4/2015 | Bachman | |
| 9,854,830 | B2 | 1/2018 | Gao et al. | |
| 2005/0115580 | A1 * | 6/2005 | Quinter | A24B 13/00 131/352 |
| 2006/0191548 | A1 * | 8/2006 | Strickland | A24B 3/14 131/347 |
| 2010/0300464 | A1 * | 12/2010 | Gee | B65D 65/46 131/275 |
| 2010/0319091 | A1 * | 12/2010 | Vainstein | C12N 15/8243 800/298 |
| 2011/0247640 | A1 * | 10/2011 | Beeson | A24B 15/24 131/275 |
| 2012/0114801 | A1 * | 5/2012 | Sasame | A23F 3/14 426/77 |
| 2012/0152265 | A1 | 6/2012 | Dube et al. | |
| 2013/0186419 | A1 | 7/2013 | Gao et al. | |
| 2014/0096780 | A1 | 4/2014 | Gerardi | |
| 2014/0261476 | A1 | 9/2014 | Mishra et al. | |
| 2015/0020818 | A1 * | 1/2015 | Gao | A24B 15/285 131/111 |
| 2015/0068545 | A1 * | 3/2015 | Moldoveanu | A24B 13/00 131/352 |

FOREIGN PATENT DOCUMENTS

| | | | |
|---|---|---|---|
| CN | 102754908 | B | 6/2015 |
| EP | 0215682 | A2 | 3/1987 |
| RU | 2127598 | C1 | 3/1999 |
| WO | WO-03/028491 | A1 | 4/2003 |
| WO | WO-2007/126361 | A1 | 11/2007 |
| WO | WO-2009/010884 | A2 | 1/2009 |
| WO | WO-2011/116977 | A1 | 9/2011 |
| WO | WO-2012/068375 | A1 | 5/2012 |
| WO | WO-2013/152918 | A1 | 10/2013 |
| WO | WO-2015/051308 | A1 | 4/2015 |
| WO | WO-2016/097294 | A1 | 6/2016 |

OTHER PUBLICATIONS

Yumen Hilal, "Morphology, Manufacturing, Types, Composition and Medical Properties of Tea (*Camellia sinensis*)", Jun. 30, 2017, J Bas Apl PI Sci 1(2): 107. (Year: 2017).*

Partial International Search Report for Application No. PCT/US2018/012054 dated Jun. 7, 2018.

Purves D, Augustine GJ, Fitzpatrick D, et at., Taste Perception in Humans, Neuroscience, 2nd Edition, Sinauer Associates, 2001.

International Search Report and Written Opinion for corresponding International Application No. PCT/US2018/012054 dated Aug. 14, 2018.

European Office Action dated Dec. 22, 2020 for corresponding European Application No. 18701609.2.

* cited by examiner

*Primary Examiner* — Cynthia Szewczyk

(74) *Attorney, Agent, or Firm* — Harness, Dickey & Pierce, P.L.C.

(57) ABSTRACT

This document relates to smokeless products containing one or more non-tobacco plant materials. Certain embodiments described in this document relate to smokeless products containing one or more tobacco-alternative plant materials and having properties similar to tobacco-containing oral products.

18 Claims, 3 Drawing Sheets

SMOKELESS PRODUCTS CONTAINING NON-TOBACCO PLANT MATERIALS

CROSS-REFERENCE TO RELATED APPLICATIONS

This application claims priority to U.S. Provisional Application No. 62/440,954, filed on Dec. 30, 2016, the contents of which are incorporated herein by reference.

TECHNICAL FIELD

This document relates to oral smokeless products containing non-tobacco plant material.

BACKGROUND

There are various types of smokeless tobacco. Certain examples of smokeless tobacco include chewing tobacco, moist smokeless tobacco ("MST"), snus, and dry snuff. Chewing tobacco includes coarsely divided tobacco leaves, which are typically packaged in a large pouch-like package and used in a plug or twist. MST is a moist, more finely divided tobacco that is provided in a loose form or in a pouch form. MST is typically packaged in round cans and used as a pinch or in a pouch placed between a cheek and gum of an adult tobacco consumer. Snus is a heat-treated smokeless tobacco. Dry snuff is finely ground tobacco that is placed in the mouth or used nasally.

SUMMARY

Disclosed herein are various embodiments of smokeless products that include non-tobacco plant material and methods related thereto. Certain embodiments described in this document relate to the smokeless products and methods that use tobacco-alternative plant materials (e.g., tea, hop vines and leaves, or the like) to partially or fully replace tobacco plant materials. The "tobacco-alternative plant material," as used in this document, describes a plant material that does not contain any tobacco plant. In various embodiments provided herein, the tobacco-alternative plant material can be used as a substitute or alternative to tobacco plant material in a consumable product. In some cases, the smokeless products provided herein mimic a MST product, but does not contain any tobacco plant material. In some cases, the smokeless products provided herein can contain a base material that includes tobacco-alternative plant materials that mimic a tobacco plant material. The "base material," as used in this document, is a material that is a major constituent, or makes up the bulk amount, of the products provided herein. In some cases, the base material constitutes at least 50 weight percent, at least 55 weight percent, at least 60 weight percent, at least 65 weight percent, at least 70 weight percent, at least 75 weight percent, at least 80 weight percent, at least 85 weight percent, or at least 90 weight percent of a final product.

Various embodiments provided herein include methods for producing smokeless products that contain a non-tobacco base material. In some cases, the smokeless product does not essential contain any tobacco plant material, for example, a product containing less than 5 weight percent, or less than 1 weight percent of a tobacco plant. For example, the treatment and processing of one or more tobacco-alternative plant materials described herein can be used to produce a non-tobacco smokeless product that has an appearance and/or texture similar to tobacco-based products, such as MST, which contains tobacco leaves.

Producing a non-tobacco smokeless product from one or more tobacco-alternative plant materials that yields flavors and/or organoleptic qualities that are similar to tobacco-based smokeless products can be quite challenging due to the inherent qualities (e.g., taster, flavor, organoleptic qualities) associated with the tobacco-alternative plant material. In some cases, the tobacco-alternative plant material can contain its own nature flavors and textures such that the tobacco-alternative plant material does not provide a flavor-neutral base. As defined herein, a "flavor-neutral base" includes a plant substance (processed or non-processed) having a neutral taste and smell. In some embodiments, flavor-neutral base can be a plant substance that is devoid of any human-perceivable taste and/or smell. As a result, products containing the tobacco-alternative plant material may not taste and feel like a tobacco-based smokeless product to an adult tobacco consumer due to the inherent flavors and textures associated with the tobacco-alternative plant material. In some cases, the tobacco-alternative plant material flavor and/or texture are highly undesirable to the adult tobacco consumer. Thus, in some cases, it can be desirable to produce a flavor neutral base material when making a product (e.g., a smokeless product) that uses one or more tobacco-alternative plant materials such that the flavors and textures associated with the tobacco-alternative natural plant material that are modified, reduced, or eliminated.

In one aspect, a smokeless tobacco product includes tobacco, and about 20 to about 70 weight percent of a flavor neutral tobacco-alternative plant material. In some embodiments, the flavor neutral tobacco-alternative plant material does not have a human perceivable taste and/or smell. In some embodiments, the product can include about 40 to about 60 weight percent of the tobacco-alternative plant material. In some embodiments, the tobacco-alternative plant material comprises a single tobacco-alternative plant material, or a mixture of two or more tobacco-alternative plant materials. In some embodiments, the tobacco-alternative plant material comprises leaves of a plant in the Camellia genus family. In some embodiments, the tobacco-alternative plant material is selected from the group consisting of thyme, lavender, rosemary, coriander, dill, mint, peppermint, Dahlias, Cinchona, Foxglove, Meadowsweet, Echinacea, Elderberry, Willow bark, tea leaves, red clover, coconut flakes, mint leaves, ginseng, apple, grape leaf, basil leaf, hop vines, hop leaves, or combinations thereof. In some embodiments, the product further comprises nicotine or a derivative thereof.

In a second aspect, a non-tobacco smokeless product includes a flavor neutral base material comprising a tobacco-alternative plant material, wherein the non-tobacco smokeless product contains essentially no nicotine.

In a third aspect, a non-tobacco smokeless product includes a base material comprising about 20 to about 70 weight percent of a tobacco-alternative plant material, and nicotine or a derivative thereof. In some embodiments, the product contains essentially no tobacco plant material. In some embodiments, the product comprises between 0.1 mg and 6.0 mg of liquid nicotine. In some embodiments, the product comprises between 1.0 mg and 3.0 mg of liquid nicotine. In some embodiments, the base material is flavor neutral, such that the base material does not have a human perceivable taste or smell. In some embodiments, the product can include about 40 to about 60 weight percent of the tobacco-alternative plant material. In some embodiments, the tobacco-alternative plant material comprises a single tobacco-alternative plant material, or a mixture of two or more tobacco-alternative plant materials. In some embodiments, the tobacco-alternative plant material comprises leaves of a plant in the Camellia genus family. In some embodiments, the tobacco-alternative plant material is selected from the group consisting of thyme, lavender, rosemary, coriander, dill, mint, peppermint, Dahlias, Cinchona, Foxglove, Meadowsweet, Echinacea, Elderberry, Willow bark, tea leaves, red clover, coconut flakes, mint leaves, ginseng, apple, corn silk, grape leaf, basil leaf, hop vines, hop leaves, or combinations thereof. In some embodiments, the tobacco-alternative plant material comprises leaves from the plant family Musaceae. In some embodiments, the tobacco-alternative plant material is an extracted residual plant material. In some embodiments, the product can include up to 40 weight percent of a humectant.

In a fourth aspect, a method of manufacturing a non-tobacco smokeless product includes applying an extraction process to one or more tobacco-alternative plant materials to produce a flavor-neutral base; and applying a heat treatment to the one or more tobacco-alternative plant materials for sterilizing the one or more non-tobacco plant materials. In some embodiments, the heat treatment comprises a steam treatment process. In some embodiments, the method further includes subjecting the one or more non-tobacco plant materials to a curing process. In some embodiments, the method further includes adding nicotine to the one or more tobacco-alternative plant materials. In some embodiments, the method further includes adding a caramel color to the one or more tobacco-alternative plant materials. In some embodiments, the method further includes adding a humectant to the one or more tobacco-alternative plant materials.

In a fifth aspect, a method of manufacturing a non-tobacco smokeless product includes applying a curing process to one or more tobacco-alternative plant materials to form a base material; and applying a heat treatment to the one or more tobacco-alternative plant materials to sterilize the tobacco-alternative plant materials. In some embodiments, the tobacco-alternative plant material comprises leaves of a plant in the Camellia genus family. In some embodiments, the method further includes adding nicotine to the one or more tobacco-alternative plant materials. In some embodiments, the method further includes adding a humectant to the one or more tobacco-alternative plant materials.

Particular embodiments of the products and methods described herein can be implemented to provide one or more of the following advantages. First, some embodiments herein may be configured to provide a non-tobacco smokeless product that can use one or more tobacco-alternative plant materials to produce a product having appearance and/or texture that mimic a tobacco-based smokeless product. In particular, some embodiments may include a non-tobacco smokeless product that does not contain any tobacco plant material, yet has an appearance, taste, and/or texture similar to a tobacco-based smokeless product.

Second, some embodiments provided herein include methods for prepare a non-tobacco plant material to achieve a non-tobacco smokeless product having an appearance, taste, and/or texture similar to a tobacco-based smokeless product. In particular, the methods provided herein can be used to remove natural flavors associated with at least one tobacco-alternative plant material. In some embodiments, methods provided herein describe processes for sterilizing the tobacco-alternative plant material and/or a final product. In some embodiments, the methods provided herein describe how to prepare a non-tobacco base material for a finished tobacco-derived, nicotine-containing product, which is similar to overall textures and oral experiences typically associated tobacco-containing products, such as MST. In some cases, the treatment techniques provided herein can produce non-tobacco products having absorption characteristics and flavor release properties similar to those associated with the various forms of tobacco products.

Unless otherwise defined, all technical and scientific terms used herein have the same meaning as commonly understood by one of ordinary skill in the art to which this invention pertains. Although methods and materials similar or equivalent to those described herein can be used to practice the invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description below. Other features, objects, and advantages of the subject matter disclosed herein will be apparent from the description and drawings, and from the claims.

DETAILED DESCRIPTION

Figure 1:
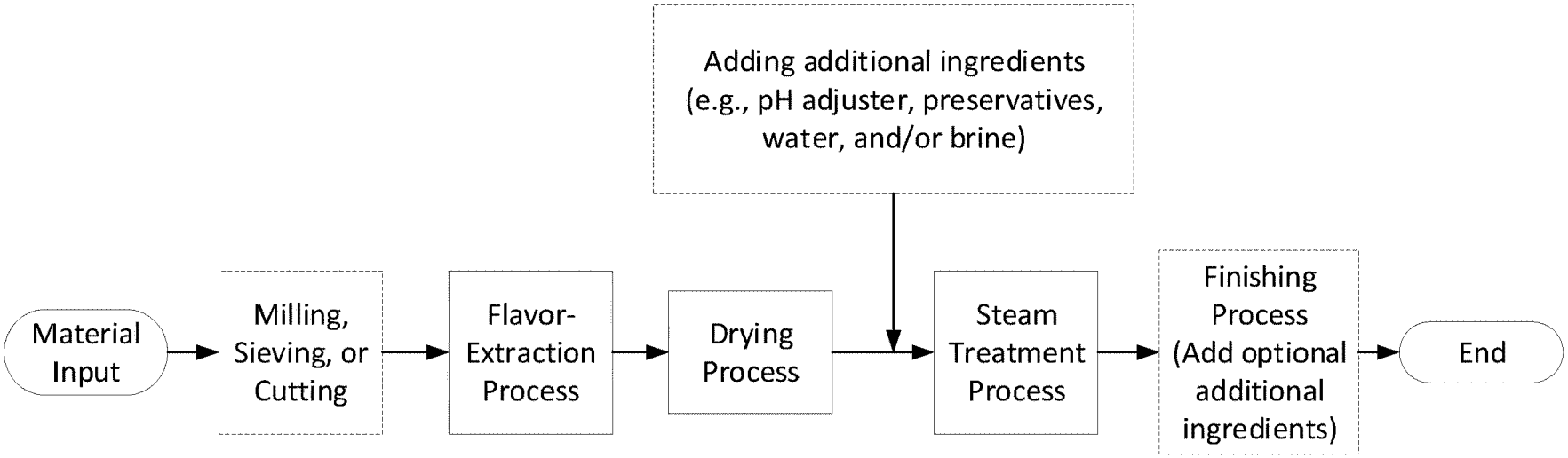
FIG. 1 illustrates an exemplary process for manufacturing a product provided herein.

This document relates to products, such as smokeless products, containing a base material including one or more tobacco-alternative plant materials as well as methods related thereto. In various embodiments, the products provided herein can have properties similar to MST products. In some embodiments, the tobacco-alternative plant material described herein can be used to produce a non-tobacco food product.

Various embodiments of the products provided herein contain one or more tobacco-alternative plant materials. In some embodiments, the products provided herein can be used to form a loose leaf smokeless product (e.g., chewing tobacco) or a smokeless product in a finely ground or cut or shredded form (e.g., fine cut, long cut dipping product, or a dip), a moist cut form, a milled form, a powder form, a pouch form, a snus, or the like. In some embodiments, the products provided herein can be used to form a smokeless product that includes a dipping product, a dip product, or a snus product. Preferably, certain embodiments provided herein can include a pouch product containing at least one tobacco-alternative plant material.

In some embodiments, the products provided herein comprise dried leaves and/or stems of one or more tobacco-alternative plant materials. In some embodiments, the products provided herein can contain at least one tobacco-alternative plant material and no tobacco plant material. In some embodiments, the products provided herein can contain at least one tobacco-alternative plant material and tobacco plant material. For example, in some embodiments, the tobacco-alternative plant materials provided herein can be used as a diluent (e.g., a filler material) for tobacco-containing products, such as MST products and snus products.

The tobacco-alternative plant materials described herein can include one or various forms. In some embodiments, one or more tobacco-alternative plant materials can be provided as dried leaves (or other plant parts, such as stems or flowers). The tobacco-alternative plant material can include any solid form that mimics the plant form typically associated with tobacco-based products. For example, certain embodiments described herein can include tobacco-alternative plant materials provided in a fine-cut form, long-cut form, snus form, or a pouch form.

One or more tobacco-alternative plant materials may be used to form the base material of the smokeless product provided herein. In some embodiments, the smokeless product can include on a dry weight percent at least 5 weight percent of one or more tobacco-alternative plant materials. In some embodiments, the smokeless product can include at least 20 weight percent, at least 30, at least 40, at least 50, at least 60, at least 70, at least 80 dry weight percent of one or more tobacco-alternative plant materials. In certain embodiments, the product can include between 10 and 80 dry weight percent of one or more tobacco-alternative plant materials. Accordingly to some embodiments, the smokeless product can include between 15 and 40 dry weight percent of the tobacco-alternative plant materials. Some embodiments of the product can have between 40 and 60 weight percent of one or more tobacco-alternative plant materials. In some embodiments, the product can include between 20 and 35 dry weight percent of one or more tobacco-alternative plant materials.

The tobacco-alternative plant materials can be used as a substitute for tobacco in the smokeless products provided herein. In some embodiments, a single tobacco-alternative plant material, or a mixture of two or more tobacco-alternative plant materials can be used to form a smokeless product. In some embodiments, one or more tobacco-alternative plant materials can be naturally sourced. Suitable tobacco-alternative plant materials can include, but are not limited to, tea, and hop vines and leaves. In some embodiments, a suitable plant material can include leaves (or other plant components) of the plant in the Camellia genus family, e.g., Camellia sinensis. In some embodiments, suitable tobacco-alternative plant materials can include a green tea, black tea, or both. Other suitable plant materials can include an herbal composition. Herbs and other edible plants can be categorized generally as culinary herbs (e.g., thyme, lavender, rosemary, coriander, dill, mint, peppermint) and medicinal herbs (e.g., dahlias, cinchona, foxglove, meadowsweet, Echinacea, elderberry, willow bark). In some embodiments, the tobacco is replaced with a mixture of non-tobacco plant materials. Such non-tobacco compositions may have a number of different primary ingredients, including but not limited to, tea leaves, red clover, coconut flakes, mint leaves, ginseng, apple, grape leaf, and basil leaf.

In various embodiments, a tobacco-alternative plant material can be selected for closely mimicking tobacco plant material. Such a tobacco-alternative plant material can be used to produce a product that mimics a tobacco-containing product having a desired cut of tobacco. For example, in some embodiments, a long-cut MST product may be mimicked by producing a product using non-tobacco leaves from the plant family Musaceae. More specifically, leaves from plants in the genus Musa may be processed, cut, and finished, as described herein at later sections, to mimic flavors, textures, and/or organoleptic properties of a MST product. In some embodiments, products containing tobacco-alternative plant materials that closely mimics a desired cut of tobacco can provide the advantage over existing non-tobacco dips by providing a consumer experience that encompasses visual appearance, textural and tactile properties (e.g., pinchability), and a mouth feel similar to a long-cut MST product. In some embodiments, Musa leaf (or leaves) can be used in a whole leaf format or cut to produce other forms of smokeless products, such as fine cut, pouched products, powdered products, and/or snus. In some embodiments, Musa leaf can be used to make products similar to MST products. The loose leaf chew product can include thrashed Musa leaf that is optionally further treated or processed to achieve a sensory performance that mimics chewing tobacco. This loose leaf material can be further processed into a formed plug or a twist once it is processed and finished.

The tobacco-alternative plant material can be prepared from a raw input material to a desired base form. For example, in some embodiments, the tobacco-alternative plant material can be prepared to produce long cut, fine cut, snus and/or pouch products by achieving a desired particle size. Suitable average particle sizes for the tobacco-alternative plant material can include an average thickness ranging from about 100 microns to about 1000 microns and an average length ranging from about 3 mm to about 20 mm. In some embodiments, the tobacco-alternative plant material can have an average particle diameter ranging from about 100 microns to about 3000 microns to mimic a fine-cut tobacco product. In some embodiments, the average particle size range of the tobacco-alternative plant material can range from about 500 microns to about 1000 microns to achieve a texture similar to a fine-cut smokeless tobacco product. In some cases, a width-to-length ratio of the particles of the tobacco-alternative plant material can range from about 1:1 to about 1:6.

The tobacco-alternative plant materials provided herein can have a total oven volatiles (e.g., moisture) content of about 10% by weight or greater; e.g., about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight.

Liquid nicotine can be included used in the products provided herein. In some cases, liquid nicotine can be tobacco-derived nicotine, synthetic nicotine, or combinations thereof. Liquid nicotine can be purchased from commercial sources, whether tobacco-derived or synthetic. Tobacco-derived nicotine can include one or more other tobacco organoleptic components other than nicotine. The tobacco-derived nicotine can be extracted from raw (e.g., green leaf) tobacco and/or processed tobacco. Processed tobaccos can include fermented and unfermented tobaccos, dark air-cured, dark-fire-cured, burley, flue cured, and cigar filler or wrapper, as well as the products from the whole leaf stemming operation. The tobacco can also be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. By processing the tobacco prior to extracting nicotine and other organoleptic components, the tobacco-derived nicotine may include ingredients that provide a favorable experience. The tobacco-derived nicotine can be obtained by mixing cured and fermented tobacco with water or another solvent (e.g., ethanol) followed by removing the insoluble tobacco material. The tobacco extract may be further concentrated or purified. In some cases, select tobacco constituents can be removed. Nicotine can also be extracted from tobacco in the methods described in the following patents: U.S. Pat. Nos. 2,162,738; 3,139,436; 3,396,735; 4,153,063; 4,448,208; and 5,487,792.

Liquid nicotine can be pure, substantially pure, or diluted prior to combination with the tobacco-alternative plant material. In some cases, liquid nicotine is diluted to a concentration of between 1 weight percent and 75 weight percent prior to mixing the liquid nicotine with the tobacco-alternative plant material. In some cases, liquid nicotine is diluted to a concentration of between 2 weight percent and 50 weight percent prior to mixing the liquid nicotine with the tobacco-alternative plant material. In some cases, liquid nicotine is diluted to a concentration of between 5 weight percent and 25 weight percent prior to mixing the liquid nicotine with the tobacco-alternative plant material. For example, liquid nicotine can be diluted to a concentration of about 10 weight percent prior to mixing the liquid nicotine with the tobacco-alternative plant material, or base of the product.

In some cases, smokeless products provided herein can include between 0.1 mg and 6.0 mg of liquid nicotine per standard portion (e.g., a pouch, or 2.0 g equivalent pinch, of fine cut or long cut MST). In some cases, a smokeless product can include between 1.0 mg and 3.0 mg of liquid nicotine per standard portion. In some cases, the nicotine can include a nicotine salt (e.g., nicotine bitartrate) or a nicotine resin (e.g., nicotine polarcilex). In some cases, the nicotine in the form of a salt or a resin can range between 0.1 mg and 6.0 mg. In some cases, a nicotine resin can include about 20-40 weight percent of nicotine. In some cases, the nicotine salt can include about 70-90 weight percent of nicotine.

Any of the products described herein can optionally include one or more additional ingredients. For example, in some embodiments, the smokeless product can include, but are limited to, one or more plasticizers, humectants, flavorants, and combinations thereof. In some embodiments, a single substance can serve as both a plasticizer and a humectant, both a humectant and a flavorant, both a plasticizer and a flavorant, or as all three. For example, propylene glycol can serve as both a plasticizer and a humectant. For example, honey can serve as both a humectant and a flavorant. Ethanol can act as a solvent, but also provide some plasticizing characteristics in the methods, systems, and products provided herein. In some embodiments, the smokeless product can include a sweetener. In some embodiments, the smokeless product can include a combination of plasticizers, humectants, solvents, sweeteners, and/or flavorants such that the base or the product in its final form mimics the flavor profile and tactile experience of certain tobacco-containing products.

Suitable plasticizers include propylene glycol, glycerin, vegetable oil, partially hydrogenated vegetable oil, and medium chain triglycerides. In some embodiments, the plasticizer can include phthalates. Esters of polycarboxylic acids with linear or branched aliphatic alcohols of moderate chain length can also be used as plasticizers. In addition to serving as a plasticizers can facilitate the manufacturing processes described below. Plasticizers can, in some embodiments, soften the product. In some embodiments, the smokeless product can include up to 40 weight percent plasticizer. In some embodiments, the product includes between 0.5 and 10 weight percent plasticizer, between 1 and 8 weight percent plasticizer, or between 2 and 4 weight percent plasticizer. For example, the smokeless product can include about 3 to 6.5 weight percent of propylene glycol.

A humectant is a substance that can be used to keep things moist. Humectants can be hygroscopic. Suitable humectants include propylene glycol, hexylene glycol, butylene glycol, glyceryl triacetate, vinyl alcohol, neoagarobiose, sugar polyols (such as glycerol, sorbitol (E420), xylitol, maltitol, mannitol, and isomalt), polymeric polyols (e.g., polydextrose), quillaia, alpha hydroxyl acids (e.g., lactic acid), glycerin, aloe vera gel, and honey. Humectants can, in some embodiments, match the bulk density of a non-tobacco base product to that of a tobacco-containing product. In some embodiments, humectants can reduce the water activity of the product. In some embodiments, the smokeless product can include up to 40 weight percent humectant. In some embodiments, the smokeless product includes between 0.5 and 35 weight percent, between 1 and 30 weight percent, between 5 and 20 weight percent, or between 10 and 15 weight percent humectant. In some embodiments, the smokeless product includes less than 40 weight percent, less than 30 weight percent, less than 20 weight percent, or less than 10 weight percent humectant.

Flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylangylang, sage, fennel, pimento, ginger, anise, coriander, coffee, mint oils from a species of the genus Mentha, cocoa, and combinations thereof. Synthetic flavorants can also be used. In certain embodiments, a combination of flavorants can be combined to imitate a tobacco flavor. The particular combination of flavorants can be selected from the flavorants that are generally recognized as safe ("GRAS").

A variety of synthetic and/or natural sweeteners can be used as in the diluent or added separately to the smokeless product. Suitable natural sweeteners include sugars, for example, monosaccharides, disaccharides, and/or polysaccharide sugars, and/or mixtures of two or more sugars. In some embodiments, a diluent can include one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. Smokeless products can, in some embodiments, include non-nutritive sweeteners. Suitable non-nutritive sweeteners may include, but are not limited to, stevia, saccharin, aspartame, sucralose, and acesulfame potassium.

The smokeless product provided herein can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. In some cases, the products described herein include a plant material (e.g., tobacco) that has an oven volatile content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The smokeless product provided herein can have a different overall oven volatiles content than the oven volatiles content of the smokeless tobacco used to make the smokeless tobacco product. The processing steps described herein can reduce or increase the oven volatiles content. The overall oven volatiles content of the smokeless tobacco product is discussed below.

The smokeless tobacco product can include between 10 weight percent and 80 weight percent of one or more tobacco-alternative plant materials on a dry weight basis. The amount of a tobacco-alternative plant material in a smokeless product on a dry weight basis can be calculated after drying the smokeless product in a pre-warmed forced draft oven (or a moisture analyzer) at 98° C. to 120° C. for about 0.5 hours to about 6 hours. The percent of the tobacco-alternative plant materials in the smokeless product is calculated as the weight of the tobacco-alternative plant material divided by the total weight of the non-volatile materials in the product. In some embodiments, the smokeless product includes between 10 and 50 weight percent tobacco-alternative plant material on a dry weight basis. In some embodiments, the smokeless product includes at least 15 weight percent of the tobacco-alternative plant material on a dry weight basis. For example, a smokeless product can include a total oven volatiles content of about 10 weight percent to about 80 weight percent, and about 15 weight percent to about 45 weight percent base on a dry weight basis. Preferably, a smokeless product can include a total oven volatiles content of about 53 weight percent to about 57 weight percent.

Methods of Manufacturing

Certain methods for producing the smokeless products provided herein can include using one or more processing techniques, or a subset of the processing techniques, for processing the tobacco-alternative plant materials described herein. The methods provided herein can be used to produce a product that mimics a tobacco-based smokeless product. For example, in some embodiments, the processing techniques applied to one or more tobacco-alternative plant materials can include, but are not limited to milling, sieving, cutting, curing (e.g., air curing, flue-curing, or fire-curing), drying, steaming, vacuum steam conditioning, fermenting, aging, and fermenting (which may also be referred to as "sweating") at least a portion of the tobacco-alternative plant materials. The processing techniques described herein can be applied to one or more tobacco-alternative plant materials to produce a fine cut form, long cut form, a milled form, or a pouched non-tobacco product.

The processing techniques described herein, such as a drying process, can be controlled such that the resulting product has an overall oven volatiles content of between 10 and 70 weight percent, or between 15 and 65 weight percent. In some embodiments, the process is controlled to have an overall oven volatiles content of at least 15 weight percent. In some embodiments, the process can be controlled to have an overall oven volatiles content of at least 20 weight percent, at least 30 weight percent, at least 40 weight percent, at least 50 weight percent, at least 60 weight percent, or at least 70 weight percent. In some embodiments, the process is controlled to have an overall oven volatiles content of less than 70 weight percent, less than 60 weight percent, less than 50 weight percent, less than 40 weight percent, less than 30 weight percent, less than 20 weight percent, or less than 10 weight percent.

Various methods for manufacturing product provided herein can control a pH range of the product at the time of production. In some embodiments, the pH range of the product at the time of production may range between 5.0 and 8.5. In some cases, a desired pH range of the products provided herein can be controlled or modified by the type of and/or amount of the base material, either before the steam treatment process or at the finishing process. Steaming can be used to help stabilize the pH level of the products provided herein. In some cases, the pH can be further modified at the finishing process. Since a natural drop in pH can occur in the product over its shelf life, pH treatment or modification of the product prior to the steam treatment process or at the finishing process can affect the pH of the final product. In some cases, a desired pH range can be obtained in the smokeless product by stabilizing the pH level in the product provided herein using a buffering system. For example, in some cases, a buffering system solution can include, but is not limited to, mixtures of carbonate and a bicarbonate compound. In some cases, the buffering system can include, but are not limited to, acetic acid/sodium acetate, citric acid/sodium citrate, malic acid/potassium malate, tartaric acid/sodium tartar-ate, and phosphoric acid/potassium phosphate.

Referring to FIG. 1, a process flow option for preparing the smokeless product provided herein includes processing techniques that may be applied to one or more tobacco-alternative plant materials (e.g., tea or a similar plant material). As depicted in the figure, the plant material is obtained (e.g., raw tea) to produce a flavor-neutral base for the smokeless product. In some embodiments, depending on the grade and particle size of the incoming material, an optional milling, sieving, and/or cutting process can be applied to the plant material to achieve the desired cut length, or a desired average particle size, as discussed herein.

During manufacturing, the plant material may be subjected to an extraction process to produce the flavor-neutral base. In some embodiments, the extraction process includes placing the plant material in a heated liquid medium, such as water at a temperature of 100° F. or higher. In some embodiments, the heated liquid medium is at a temperature of at least 120° F., at least 130° F., at least 140° F., at least 160° F., or between 180° F. and 240° F. In some embodiments, multiple extractions are performed until effluent from the plant material appears clear. The extraction process can be used to remove natural flavors and fine particles from the plant material. As such, this processing step yields the residual plant material of interest—that is, a flavor neutral base material—that can be used for the smokeless product. In some embodiments, the extraction process can be used to significantly reduce constituents present in the plant material, such as caffeine present in tea. For example, in some embodiments, the extraction process can reduce the amount of caffeine present in tea plant material by more than 50%, more than 60%, more than 70%, more than 80%, more than 90%, or more than 99%. In some cases, the extraction process can be utilized to adjust the absorption capacity of the final product and/or the release of the added flavors in the final product.

Still referring to FIG. 1, the residual plant material can be subjected to a drying process to achieve a desired oven volatile range. In some embodiments, the drying process may or may not be used depending on the extraction technique applied on the plant material. In some embodiments, the residual plant material may require drying to achieve an oven volatile range of between 25 weight percent and 70% weight percent, or any of the oven volatile ranges provided herein.

In some embodiments, to further facilitate the materials stability as a finished product, the pH of the residual plant material can be adjusted as desired. In some embodiments, the pH of the residual plant material can be adjusted to achieve a pH of between 5 and 10.

Still referring to FIG. 1, in some embodiments, the residual plant material can be subjected to a heat treatment for sterilization. In some embodiments, the heat treatment may include a steam treatment process. In some embodiments, the heat treatment (e.g., steam treatment) can be performed for a combined effect of setting the pH, modifying the texture of the residual plant material, and sterilizing the residual plant material. In some embodiments, a steam treatment process can be applied produce a product having a final pH of between 7.0 and 8.5. The steam processing can result in producing in a more stable base having a pH in the alkaline range. Residual plant materials typically have a natural pH that resides in the acidic range. In some cases, the steam treatment processing can add steam at a pressure range of about 0 psig to about 200 psig.

During manufacturing, the residual plant material can be mixed together with additional ingredients (e.g., flavors or colorings) to generate a product that is similar to a MST product, but does not include any tobacco plant material.

In some embodiments, a desired amount of nicotine can be added to the product provided herein to mimic consumer experiences associated with MST. For example, as previously discussed herein, nicotine can include between 0.1 mg and 6.0 mg of liquid nicotine per standard portion (pouch or 2.0 g equivalent pinch of fine cut or long cut MST). In some cases, the product can include between 1.0 mg and 3.0 mg of liquid nicotine. In some cases, various forms of nicotine may be added to the product. For example, in some embodiments, the forms of nicotine can include, but are not limited to, liquid nicotine, nicotine resin, and nicotine salt. In some cases, the product can include nicotine in the form of a salt or a resin in an amount ranging between 0.10 mg and 6.0 mg. Anti-oxidants may be incorporated into the nicotine or the final product for stabilizing the nicotine.

Figure 2:
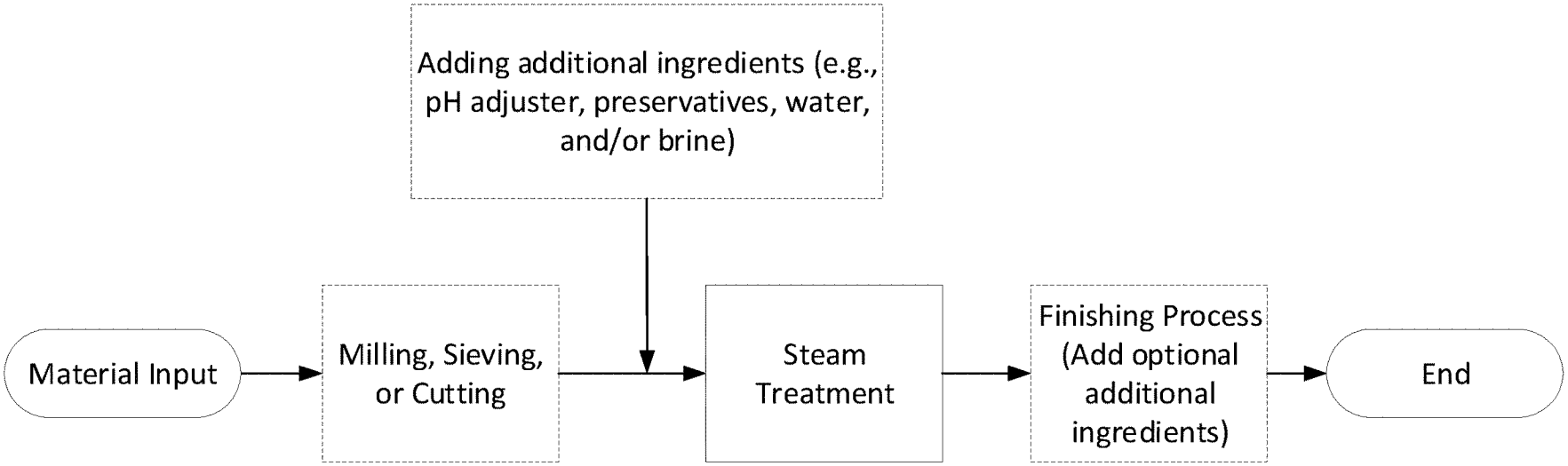
FIG. 2 illustrates an alternative exemplary process for manufacturing a product provided herein.

Referring to FIG. 2, another exemplary process flow for preparing a tobacco-alternative plant material can be used to produce the smokeless products provided herein. In some embodiments, the inputted tobacco-alternative plant material contains a desired flavor, thus there is no need to produce a flavor-neutral base. In such embodiments, the tobacco-alternative plant material provides a flavored base. The flavored base does not need to be subjected to an extraction process as described above in FIG. 1. In some embodiments, the tobacco-alternative plant material may not have a flavor that is detectable and thus the tobacco-alternative plant material naturally provides a neutral base. In some cases, no extraction process is required to be applied to produce a neutral base.

In some embodiments, during manufacturing, the plant material may be optionally mixed with pH adjusters and preservatives, as described previously herein.

Still referring to FIG. 2, the plant material may be fed directly, or after the pH adjustment, into a steam treatment process.

After the steam treatment, the product may optionally mixed together with flavors and/or other ingredients, as described herein with respect to the process described in FIG. 1.

Figure 3:
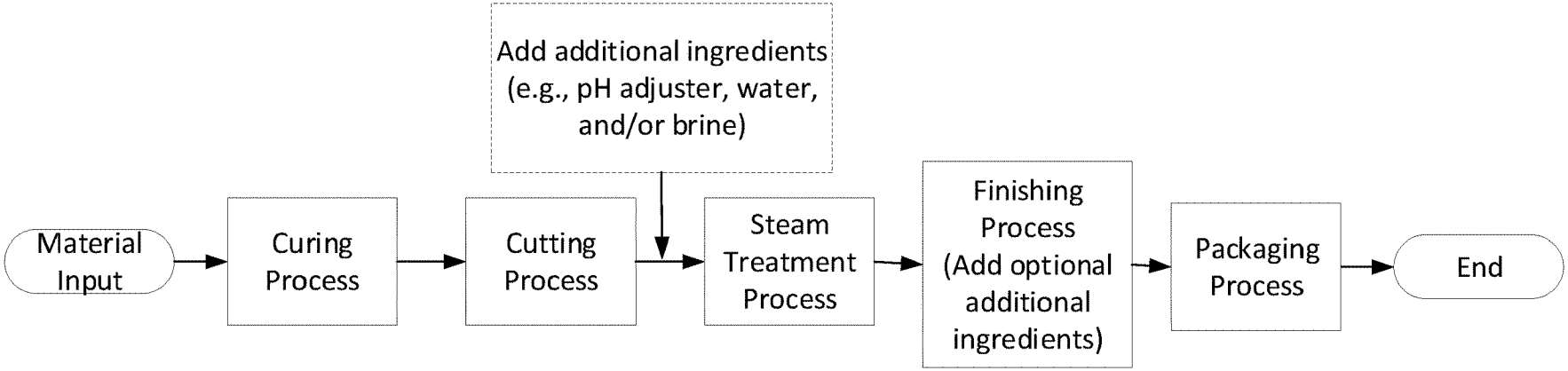
FIG. 3 illustrates another exemplary process flow for manufacturing a product provided herein.

FIG. 3 illustrates another exemplary process flow for preparing a tobacco-alternative plant material to produce products provided herein. As shown, the process flow includes obtaining at least one tobacco-alternative plant material; applying a curing process and a cutting process; adding ingredients to the tobacco-alternative plant material; and applying a steam treatment process, a finishing process, and a packaging process. As depicted, the tobacco-alternative plant material can be obtained (e.g., leaves of Musa plant) to produce the base for the smokeless product. In some embodiments, the manufacturing process can include curing the plant material to achieve a desired plant texture and/or color. The curing process can, in some embodiments, achieve a texture similar to the texture generally associated with tobacco plant. In some cases, the curing process applied to the plant material can be the same as or similar to that of air-cured, flue-cured, fire-cured, or sun-cured tobacco. In some embodiments, depending on the grade and size of the incoming plant material, a cutting process can be applied to the inputted plant material(s) to achieve the desired cut length, or an average particle size, as discussed above.

As depicted in FIG. 3, one or more additional ingredients (e.g., a pH adjuster) can be added to the tobacco-alternative plant material during processing of the products provided herein. In particular, in some cases, the additional ingredients can be added after the curing process and before the steam treatment process. In some cases, the additional ingredients can be added at any time during the processing of the tobacco-alternative plant material (e.g., before the curing process, after the curing process, before the cutting process, after the cutting process, before the steam treatment process, after the steam treatment process, before the finishing process, after the finishing process, before the packaging process, and/or after the packaging process). The one or more additional ingredients can include, but are not limited to, a pH adjuster (e.g., sodium carbonate, sodium bicarbonate, or mixtures thereof), water, a brine, a preservative, a flavorant, and combinations thereof. The brine is a solution that can include water and one or more inorganic salts, such as NaCl, KCl, Na, SO, K, NaNO, KNO, MgCI, MgSO, CaOl, or combinations thereof. In some cases, the brine can include salts of strong acids and weak bases and, if desired, an acid or an appropriate buffer salt. Suitable acids can include but are not limited to hydrochloric, sulfuric, citric, phosphoric, acetic, tartaric, and malic acids.

In some embodiments, the plant material can be subjected to a heat treatment for sterilization, such as a steam treatment process as described above.

In some embodiments, the plant material can undergo a finishing process that includes adding additional ingredient, such as one or more flavorants. In some embodiments, nicotine may be added to the plant material during the finishing process.

In some embodiments, the tobacco-alternative plant material can be subjected to a finishing process that includes adding at least one colorant, such as a caramel colorant or extract.

The finished product can be obtained following a packaging process. In some embodiments, the product provided herein can be placed into a container, such as a can, a bag, or a pouch. In some embodiments, the finished product may be packed into a box to facilitate convenient and efficient shipping.

In some cases, the product provided herein can be finished, packaged, and/or treated in a nitrogen gas environment or with nitrogen gas to reduce the amount of oxidation of particular components (e.g., flavors and/or nicotine) in the final product. This can help to extend the product stability over a desired shelf life.

In some cases, the smokeless products provided herein can be pouched and packaged using methods described in U.S. Patent Publication No. 2014/0261480, U.S. Patent Publication No. 2014/0261472, and U.S. Patent Publication No. 2014/0261473, which are incorporated herein by reference in their entirety.

Any of the examples provided herein (e.g., as shown in FIGS. 1-3) can be applied for processing tobacco-alternative plant materials and/or tobacco plant material. In some cases, any one of the examples described herein can be applied to processing only tobacco-alternative plant materials, only tobacco plant materials, or a mixture of tobacco-alternative plant materials and tobacco plant material.

Certain embodiments of the present disclosure include non-tobacco "spit-free" smokeless products containing a MST flavor. In some embodiments, the products described herein can have the taste of a tobacco-containing smokeless product, but contain essentially no tobacco, or a small amount of tobacco that would be less than an amount typically found in MST products. The products described herein can be provided in loose portions or compact portions of various different sizes and shapes. Advantages of the non-tobacco products described herein include the use of tobacco alternatives (e.g., substrates derived from tea, coffee, corn silk, or the like) that are more widely available, and/or less costly. In some embodiments, one or more tobacco alternatives can be combined or blended with a tobacco-based MST ingredients at different ratios (e.g., 1:1, 1:2, 1:3, 1:4, 1:5, 1:6, 1:7, 1:8, 1:9, or up to 1:10 of non-tobacco smokeless ingredient to tobacco-based MST ingredients) or different proportions.

Any one of the products described herein can include flavor beads. The flavor beads can include one or more flavors, such as tobacco flavor, wintergreen flavor, and mint flavor. In some embodiments, the flavor bead can be made of unmodified or modified edible starch. In some embodiments, the flavor bead can include edible biopolymers. Exemplary biopolymer can include, without limitation, polysaccharides, proteins, and combinations thereof. Polysaccharides can include, without limitation, hydroxypropyl methyl cellulose (HPMC), microcrystalline cellulose, corn starch, carrageenan, pectin, alginate, xanthan gum, konjac gum, locust bean gum, other natural biopolymers, and combinations thereof. Exemplary proteins can include, without limitation, milk protein, whey protein, egg white protein, soy protein, wheat protein, tobacco protein fractions, rice protein, fish meal protein, gelatin proteins from bovine, porcine or fish, a tobacco extract protein, protein hydrolyzates group, and mixtures or combinations thereof. In some embodiments, the flavor beads can include tobacco flavoring, or other complementary flavors, or cooling agents. In some embodiments, the flavor beads can provide a time-released flavor (e.g., after 1 second, 5 seconds, 10 seconds, 30 seconds, 1 minute, 3 minutes, 10 minutes, 30 minutes, 1 hour, 2 hours or longer) after the product is placed into a mouth.

While this specification contains many specific implementation details, these should not be construed as limitations on the scope of invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some embodiments be excised from the combination, and the claimed combination may be directed to a subcombination or variation of a subcombination.

In addition to being directed to the teachings described above and claimed below, products and/or methods having different combinations of the features described above and claimed below are contemplated. As such, the description is also directed to other products and/or methods having any other possible combination of the dependent features claimed below.

All references, publications, and patents referred to herein, including the figures and drawings included therewith, are incorporated by reference in their entirety.

What is claimed is:

1. A smokeless tobacco product comprising:

tobacco; and a flavor neutral tobacco-alternative plant material in an amount ranging from 20 to 70 weight percent, the flavor neutral tobacco-alternative plant material including leaves of a plant in the *Camellia* genus family, and the flavor neutral tobacco-alternative plant material being a modified plant material free of a human perceivable taste, the smokeless tobacco product having a total oven volatiles content ranging from 53 to 57 weight percent.

2. The product of claim 1, wherein the flavor neutral tobacco-alternative plant material comprises a single tobacco-alternative plant material, or a mixture of two or more tobacco-alternative plant materials.

3. The product of claim 1, wherein the flavor neutral tobacco-alternative plant material further includes thyme, lavender, rosemary, coriander, dill, mint, peppermint, Dahlias, Cinchona, Foxglove, Meadowsweet, *Echinacea*, Elderberry, Willow bark, tea leaves, red clover, coconut flakes, mint leaves, *ginseng*, apple, grape leaf, basil leaf, hop vines, hop leaves, or any combination thereof.

4. The product of claim 1, further comprising nicotine or a derivative thereof.

5. The product of claim 1, wherein the modified plant material has a reduced caffeine content compared to an unmodified plant material.

6. The product of claim 1, wherein the product includes the flavor neutral tobacco-alternative plant material in an amount ranging from 40 to 60 weight percent.

7. The product of claim 1, wherein the flavor neutral tobacco-alternative plant material has an average particle diameter ranging from 100 microns to 3,000 microns.

8. The product of claim 1, wherein the flavor neutral tobacco-alternative plant material has an average thickness ranging from 100 microns to 1,000 microns and an average length ranging from 3 mm to 20 mm.

9. The product of claim 1, wherein the flavor neutral tobacco alternative plant material defines a width-to-length ratio ranging from 1:1 to 1:6.

10. The product of claim 1, further comprising:

a plasticizer in an amount ranging from 0.5 to 10 weight percent.

11. The product of claim 1, further comprising:

a humectant in an amount ranging from 0.5 to 35 weight percent.

12. The product of claim 1, further comprising:

a flavorant including licorice, wintergreen, cherry and berry type flavorants, Drambuie, bourbon, scotch, whiskey, spearmint, peppermint, lavender, cinnamon, cardamon, *apium graveolens*, clove, cascarilla, nutmeg, sandalwood, bergamot, geranium, honey essence, rose oil, vanilla, lemon oil, orange oil, Japanese mint, *cassia*, caraway, cognac, jasmine, chamomile, menthol, ylang-ylang, sage, fennel, pimento, ginger, anise, coriander, coffee, mint oils from a species of the genus Mentha, cocoa, or any combination thereof.

13. The product of claim 1, further comprising:

flavor beads configured to provide time-released flavor.

14. The product of claim 1, further comprising:

a diluent including sucrose, honey, glucose, molasses, corn sweetener, corn syrup, fructose, lactose, maltose, sorghum syrup, mannitol, fruit juice concentrate, or any combination thereof.

15. The product of claim 1, further comprising:

a caramel colorant.

16. The product of claim 4, further comprising:

an antioxidant.

17. The product of claim 4, wherein the product includes the nicotine and the nicotine is liquid nicotine.

18. The product of claim 17, wherein the product includes the liquid nicotine in an amount ranging from 0.1 mg to 6 mg.

* * * * *